United States Patent [19]

Keem et al.

[11] Patent Number: 4,867,785

[45] **Date of Patent: * Sep. 19, 1989**

[54] METHOD OF FORMING ALLOY PARTICULATES HAVING CONTROLLED SUBMICRON CRYSTALLITE SIZE DISTRIBUTIONS

[75] Inventors: John Keem, Bloomfield Hills; Jun S. Im, Detroit; John Tyler, Grosse Pointe Park; Richard Bergeron, Romulus; Kevin Dennis, Detroit; David Hoeft, Clawson, all of Mich.

[73] Assignee: Ovonic Synthetic Materials Company, Inc., Troy, Mich.

[ * ] Notice: The portion of the term of this patent subsequent to Feb. 9, 2005 has been disclaimed.

[21] Appl. No.: 191,626

[22] Filed: May 9, 1988

[51] Int. Cl.[4] ..... H01F 1/02

[52] U.S. Cl. ..... 75/0.5 C; 75/0.5 BA; 148/403

[58] Field of Search ..... 75/0.5 C, 0.5 BA; 148/403

[56] References Cited

U.S. PATENT DOCUMENTS

| | | | |
|---|---|---|---|
| 4,233,062 | 11/1980 | Siddall | 75/0.5 C |
| 4,264,641 | 4/1981 | Mahoney et al. | 75/0.5 C |
| 4,306,901 | 12/1981 | Szekely | 75/0.5 BA |
| 4,647,305 | 3/1987 | Kumai et al. | 75/0.5 C |
| 4,723,994 | 2/1988 | Ovshinsky et al. | 75/0.5 C |
| 4,781,754 | 11/1988 | Soranno et al. | 75/0.5 C |

*Primary Examiner*—Upendra Roy

*Attorney, Agent, or Firm*—Richard M. Goldman; Marvin S. Siskind; Kenneth M. Massaroni

[57] ABSTRACT

Disclosed is a controlled pressure melt spinning method of rapidly solidifying alloys to obtain a solid alloy of controlled mean crystallite size, narrow crystallite distribution, and a fine grain microstructure.

31 Claims, 5 Drawing Sheets

FIG. 8
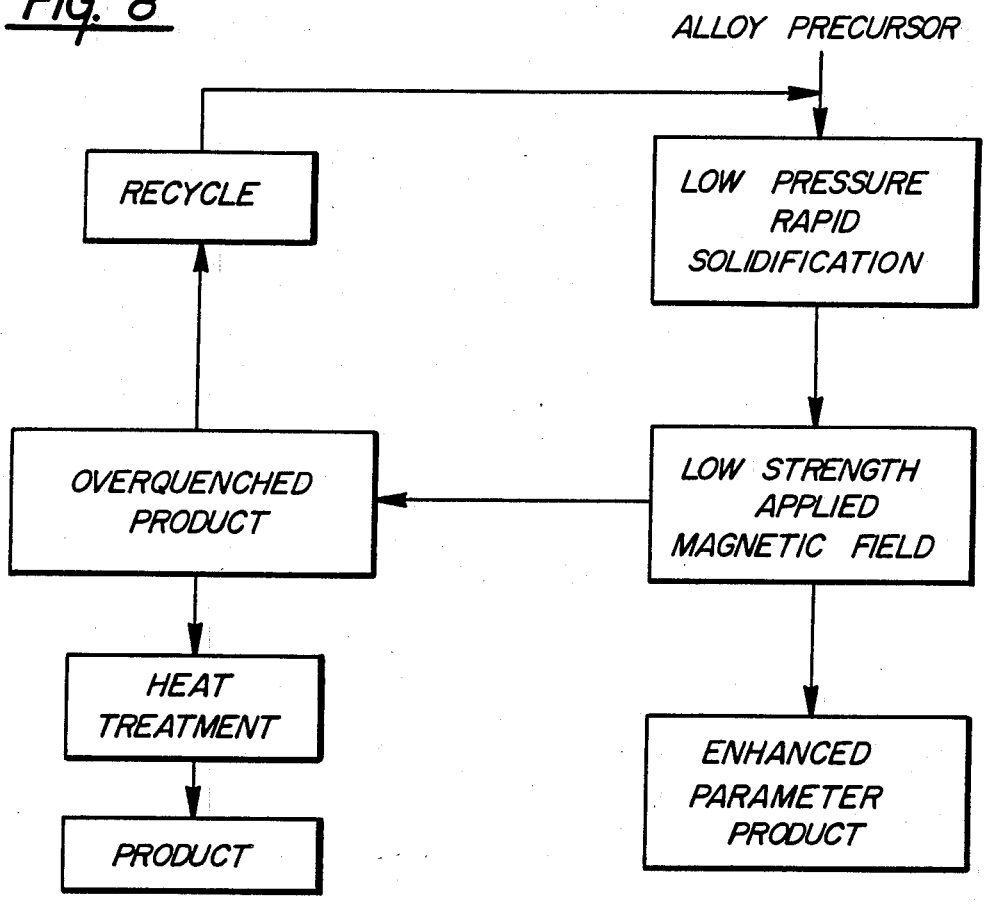
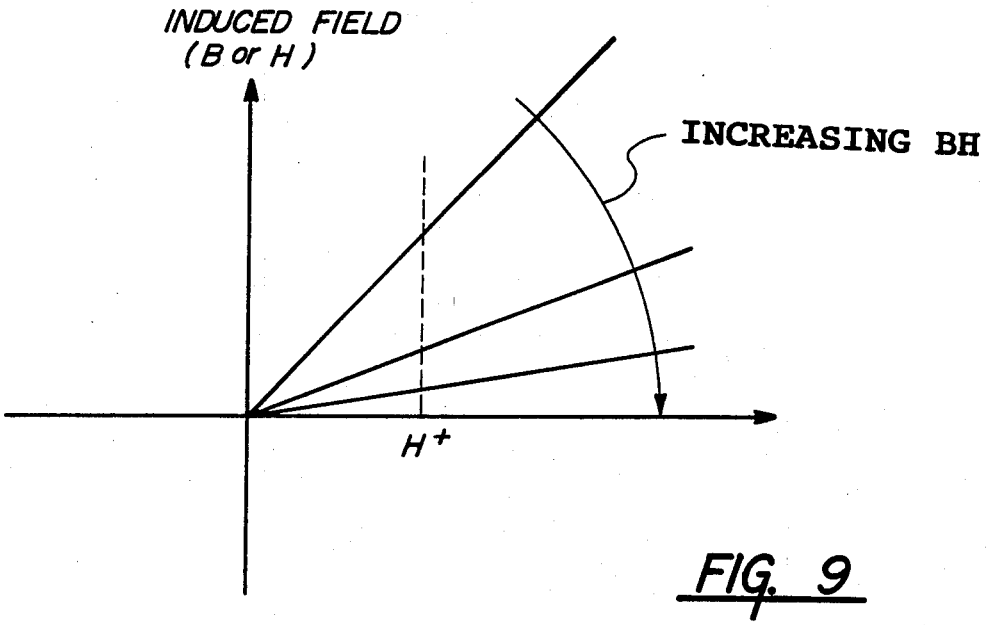
FIG. 9

METHOD OF FORMING ALLOY PARTICULATES HAVING CONTROLLED SUBMICRON CRYSTALLITE SIZE DISTRIBUTIONS

FIELD OF THE INVENTION

The invention relates to subatmospheric pressure rapid solidification methods for obtaining alloys having morphologies characterized by a uniform, fine grain size distribution. In a preferred exemplification the subatmospheric pressure rapid solidification can be used to obtain ferromagnetic alloys having the morphologies necessary for enhanced magnetic parameters. The rapid solidification method of the invention can also be used for the synthesis of particulate super alloys and as well the synthesis of particulate catalysts.

BACKGROUND OF THE INVENTION

Increased performance of many materials is dependent upon a uniform morphology, having a narrow distribution of a morphological properties about a mean morphological value, where the mean morphological value (which may be determined by fabrication parameters) is close to or even equals a characteristic dimension which is by, e.g., a balance between atomic scale parameters and the intended use of the material. Examples include the crystallite sizes and size distribution of, for example, magnetic alloys, and super alloys, and the pore sizes and pore size distributions of heterogeneous catalysts.

The magnetic materials described in our commonly assigned, copending U.S. application Ser. No. 893,516 filed Aug. 6, 1986 of R. Bergeron, et al for Enhanced Remanence Permanent Magnetic Alloy AND Bodies Thereof, and a continuation-in-part thereof also entitled Enhanced Remanence Permanent Magnetic Alloy AND Bodies Thereof filed of even date herewith, both of which are hereby specifically incorporated herein by reference, describe magnetic materials having isotropic magnetic parameters exceeding those predicted by the non-interactive model of the prior art.

As described in the above patent applications, the morphologies necessary for enhanced magnetic parameters include the crystallite grain boundaries being sufficiently free of substantially continuous intergranular phases, and the individual crystallites having dimensions distributed about a material specific characteristic dimension $R_o$ so as to produce a tendency to align the magnetic moments of adjacent crystallites and provide the enhanced magnetic parameters. The material specific characteristic dimension, $R_o$, is determined by, at least, (i) the interatomic distance of the atoms in the material, (ii) the magnetic exchange field of the material, (iii) the magnetic anisotropy field of the material, and (iv) a material specific scaling factor. The above mentioned properties, i.e., interatomic distance, magnetic exchange field, magnetic anisotropy field and scaling factor, are all material dependent, and there is no one universal value of $R_o$ for all materials. As described in the above referenced patent applications, for the $RE_2Fe_{14}B$— type systems, theoretical calculations, with simplifying assumptions, predict a characteristic dimension in the range of 140 Angstroms to 230 Angstroms, with all crystallites having dimensions within a close distribution thereabout, while our observations for materials of the $Re_2Fe_{14}B$—type confirm that enhanced parameters are observed when the mean crystallite characteristic dimension is within a broader range of 140 to 300 Angstroms, and a major portion of the crystallites have their dimensions closely distributed about the mean.

The actual short range local order of the enhanced magnetic parameter materials is a strong function of the instantaneous and time averaged local cooling rate (temperature change per unit time) and the instantaneous and time averaged thermal flux (energy per unit time per unit area). The solidification and crystallization processes occur with initial cooling rates of 100,000 to 1,000,000 degrees Celsius per second, and average temperature drops (temperature drop while on the chill surface divided by residence time on the chill surface) of 10,000 to 100,000 degrees Celsius per second. These cooling rates drive local instantaneous heat fluxes of hundreds of thousands of calories per square centimeter per second, and average heat fluxes of 10,000 to 100,000 calories per square centimeter per second. Within this cooling rate and heat flux regime, local, short duration upsets, transients, and excursions of the melt pool over the solidifying flakes, splashing of the molten alloy, changes in incoming flow of the molten alloy, formation and passage of alloy-crucible reaction products (slags and oxides) through the crucible orifice, and even bubbles of inert gases as argon entrained under the solidifying flake, and the like, result in a product containing a range of flake and ribbon sizes, crystallite sizes, and crystallite magnetic parameters, ranging from overquenched to underquenched.

A significant problem of early melt spinning trials was the effect of quench transients on the yield, i.e., (1) the final magnetic properties of a major portion of the material, and the (2) fraction of product having magnetic parameters above a threshold value. Prior attempts to control the quench parameters, and especially transients, in order to optimize a property or properties of the quench were generally partially successful, resulting in ribbon product having crystallite dimensions from tens of Angstroms to microns, and a concommitant range of magnetic parameters. This is illustrated in Run 502AB01 of Example IV of Ser. No. 893,516 showing overquenched, underquenched, and near optimum materials in the same melt spun ribbon. By providing a wide range of magnetic parameters that could be correlated with the structural parameters, atmospheric pressure solidification was scientifically very significant. Atmospheric pressure melt spinning allowed synthesis of sufficient material for separation, identification, and characterization of interactive materials of enhanced magnetic parameter material, and especially for comparison and characterization of interactive and non-interactive materials from the same melt spinning run. This is illustrated in Example IV of U.S. application Ser. No. 893,516. Atmospheric pressure melt spinning resulted in a range of magnetic parameters, including scientifically very significant amounts of magnetic materials that exceeded the Stoner and Wohlfarth limits of $(BH)=(M_{sat}/4)^2$ and $M_{rem}=(M_{sat}/2)$.

SUMMARY OF THE INVENTION

According to the method of the invention, high yields of alloys having a uniform, fine grain morphology are obtained by a subatmospheric pressure method of rapid solidification. In a preferred exemplification, this method provides a particulate product containing a very high fraction, e.g., at least about 40 weight percent, and even 60 or more weight percent alloy material with the required crystallite morphology to have enhanced magnetic parameters.

According to the invention disclosed herein, the precursor alloy is solidified by melt spinning under controlled pressure to optimize, for a particular application, either or both of (1) the mean crystallite size and/or (2) the crystallite size distribution about the mean crystallite size.

In the case of interactive ferromagnetic materials the method of the invention can be used to optimize either or both of:

(1) the highest magnetic parameters of the highest recoverable fraction of the product, or (2) the fraction of product above a target or threshold magnetic parameter.

In the case of heterogeneous catalyst materials, as Raney catalysts, the method of invention can be used to optimize the crystallite size and size distribution in a precursor alloy, e.g., a Ni-Al alloy, so as to optimize the ultimate surface area per unit mass, porosity, and pore size distribution of the Raney catalyst.

In the case of super alloys the method of the invention can be used to optimize the crystallite sizes of the various phases to optimize the mechanical properties of the alloy.

Preferably, the pressure is subatmospheric pressure and produces an optimized particulate product as defined above. In the case of particulate ferromagnetic alloys this is a particulate product that is rich in enhanced magnetic parameter material. According to the invention, a supply of the molten precursor is established in a vessel in proximity to the chill surface, and a stream of the molten precursor is ejected from the vessel, through a subatmospheric pressure environment, typically comprising a non-reactive gas, onto the rapidly moving chill surface. The molten stream impinges onto the chill surface in the subatmospheric pressure environment causing the quenched material, e.g., a discontinuous stream of particles of the alloy, to be thrown off of the rapidly moving chill surface. These particles travel through the subatmospheric pressure environment. The particles are recovered as a fine crystallite size alloy having a high fraction of material with a crystallographic size distribution closely distributed about a mean size.

The non-reactive gas used to provide the subatmospheric pressure gas is typically an inert gas, and is preferably chosen from the group consisting of helium, argon, and mixtures thereof. Most preferably, the non-reactive gas is argon. Alternatively, hydrogen may be used alone or with one of the inert gases. Generally is below about 200 to 400 millimeters of mercury, absolute.

A further aspect of process control lies in maintaining the molten precursor quiescent in the vessel in order to reduce transients in the ejection pressures. This may be accomplished, for example, by indirectly heating the molten precursor, as by indirectly inductively heating the molten precursor. Thus, in one embodiment, the molten precursor is heated with an electrical field that is electrically decoupled from but thermally coupled to the molten precursor. This maintains the precursor both molten and substantially quiescent.

In a particularly preferred exemplification of the invention where a ferromagnetic alloy is synthesized, the molten alloy is solidified from a substantially quiescent melt by subatmospheric pressure melt spinning, and the resulting solidified product may be magnetically separated into enhanced parameter and conventional parameter fractions in a magnetic separation, i.e., sorting, process. The magnetic separation process utilizes the surprisingly relatively higher induced magnetization of the conventional, non-interactive material and relatively lower induced magnetization of the interactive materials, both in a low strength applied magnetic field to effect separation, as described in commonly assigned, copending U.S. application Ser. No. 063,936 filed June 19, 1987 of John E. Keem and Jun Su Im for Method OF Manufacturing, Concentrating, AND Separating Enhanced Magnetic Parameter Material From Other Magnetic Co-Products, incorporated herein by reference.

THE FIGURES

The invention may be understood by reference to the following figures.

FIG. 1 is a representation of a distribution curve showing a ferromagnetic alloy prepared according to one exemplification of the invention, maximum magnetic energy product, $(BH)_{max}$, versus mean crystallite size and crystallite size distribution about the mean.

FIG. 2 is a map of the raw data of Example 1 (Sample 539AA) showing yields and magnetic parameters as a function of Wheel Speed and chamber pressure. FIG. 2 shows the locations of the Data Points on a plot of Wheel Speed versus Chamber Pressure. Table 1-3 is table showing the actual data, where the "Data Point" column refers to the Data Points in FIG. 2. The plot of FIG. 2A and the Data Points of Table 1-3 were used to construct FIGS. 3 and 4.

FIG. 8 is a flow chart for an integrated magnetic alloy synthesis process including reduced pressure melt spinning and magnetic sorting.

FIG. 9 is a representation of the low field region of the first quadrant portion of the magnetization curve of an overquenched material pictorially superimposed atop a representation of the same low field region of the same first quadrant portion of the magnetization curve of an enhanced remanence material.

FIG. 10 is a plot of magnetic sorter magnetizer current versus energy product for the material of samples MS265 and 491AC11.

DETAILED DESCRIPTION OF THE INVENTION

The invention described herein is a controlled pressure rapid solidification process for the fabrication of metallic materials having a controlled morphology, e.g., mean crystallite size and a narrow distribution of crystallite sizes about the mean. The desired and actual mean crystallite sizes, and the distributions of crystallite sizes about the mean crystallite sizes are separately determined by many factors. In the case of enhanced parameter ferromagnetic materials, the desired mean crystallite size and crystallite size distribution is determined by atomic level interactions, while in the case of porous catalysts the desired pore size and pore distribution is determined by the kinetics, thermodynamics, and reaction pathways of the catalyzed reaction and the mass transfer properties of the reaction to and products. However, in all cases the actual mean crystallite size and size distribution are determined by local quench parameters.

Figure 1:
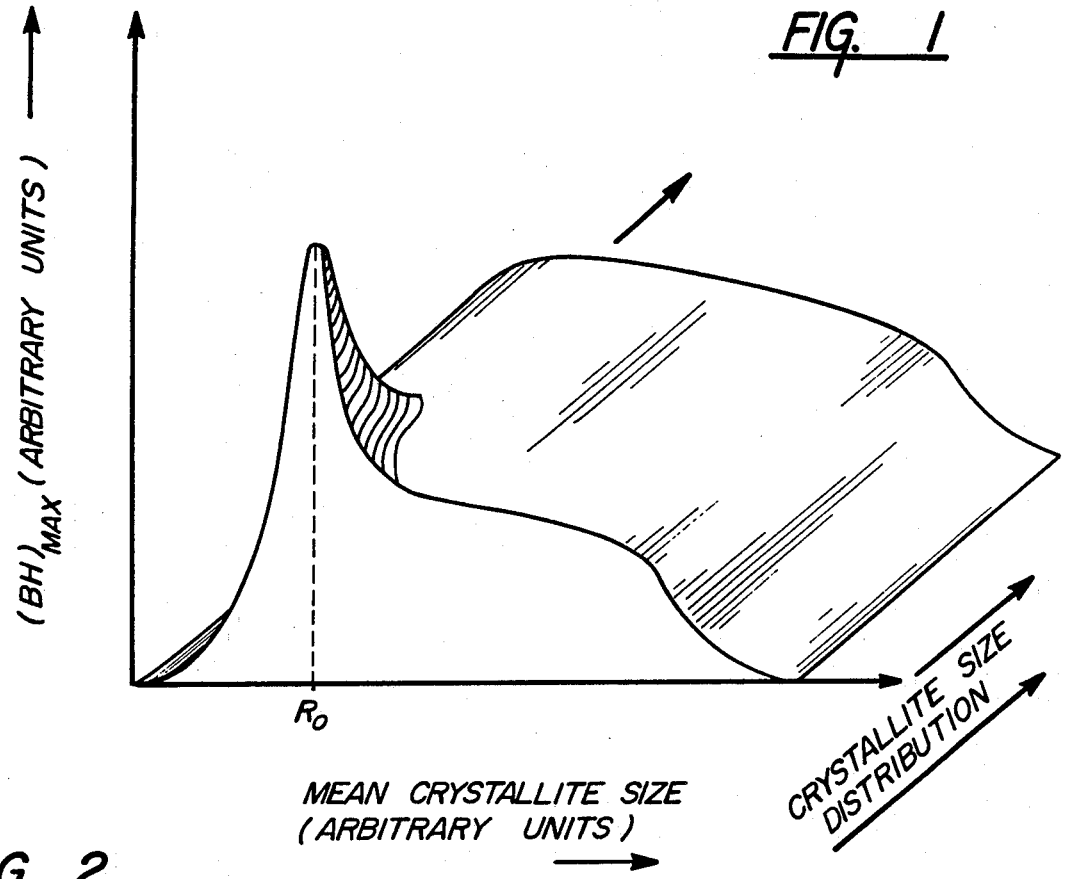

In the case of these enhanced parameter ferromagnetic materials, the mean crystallite size, the distribution of crystallite sizes about the mean, and the range of crystallite sizes obtained by controlled pressure rapid solidification are such as to obtain enhanced magnetic parameters. For enhanced parameter magnetic materials, the enhanced magnetic parameters, as remanence, and energy product, are strongly correlated with the mean crystallite size, crystallite size range, and crystallite size distribution. FIG. 1 is a qualitative representation of the relationship between one magnetic parameter, the maximum magnetic energy product (in arbitrary units) as a function of two measures of crystal morphology, the mean crystallite size (in arbitrary units) and the distribution of the crystallite size about the mean crystallite size (in arbitrary units).

FIG. 1 illustrates that, in accordance with the interaction model described in our commonly assigned, copending U.S. application Ser. No. 893,516, and in Attorney Docket 843.7, both previously incorporated by reference, there is disclosed a range of mean crystallite size and crystallite size distribution around a material specific characteristic crystallite size or dimension, $R_o$, (determined by atomic level interactions) that gives rise to enhanced magnetic parameters. The enhanced properties associated therewith diminish quickly outside of these narrow ranges. As seen in FIG. 1, mean crystallite sizes smaller then $R_o$ tend to result in an "over quenched" material, and crystallite sizes larger than $R_o$ tend to result in an "under quenched" material, both of which have lower energy products than the optimum crystallite size enhanced parameter material.

RELATIONSHIP BETWEEN MORPHOLOGY AND ENHANCED MAGNETIC PARAMETERS

For ferromagnetic materials prepared by the method of the invention, two aspects of material morphology, namely crystallite size and grain boundary phase distributions, must be controlled to material specific tolerances in order to obtain enhanced parameters. The individual crystallites each have individual dimensions, as a diameter or a length. The dimensions of an individual crystallite are mechanistically determined according to the invention described herein by the factors that determine nucleation, growth, and solidification processes. The material also has a material specific characteristic dimension, $R_o$. As described in the aforementioned U.S. patent application Ser. No. 893,516 qualitatively the characteristic dimension, $R_o$, is that crystallite dimension which causes the exchange energy between conduction band electrons on the surfaces of adjacent crystallites to approximately equal the anisotropy energy within each of the crystallites, thereby giving rise to enhanced parameters.

The maximum enhancement of magnetic energy product is seen when all of the individual crystallites have their individual characteristic dimensions approximately equal to the calculated characteristic dimension, $R_o$, and the grain boundary morphology does not interfere with ferromagnetic electron spin coupling thereacross.

The exact values of $R_o$ are dependent on composition. In the case of 2-14-1 material i.e., materials of the tetragonal $Fe_{14}Nd_2B_1$—type having a $P4_2/mnm$ crystallographic space group, the characteristic dimension, $R_o$ depends on the relative fractions of Fe and Co, both with respect to each other and with respect to the total composition, the relative fractions of Nd, Pr, and other rare earths, as La, both with respect to each other, and with respect to the total composition, the functions of B, and the functions, if any, of modifiers as Si and Al. In the case of 2-14-1 type materials, $R_o$ is seen to be between 140 and 300 Angstroms, as described in our commonly assigned, copending application, Attorney Docket No. 843.7.

RELATIONSHIP BETWEEN MORPHOLOGY DISTRIBUTIONS, PRODUCT PROPERTIES AND QUENCH PARAMETERS

Ferromagnetic alloys containing high fractions of the above described morphologies and consequent magnetic parameters associated therewith are manufactured by the low pressure rapid solidification melt spinning method of the instant invention, optionally with subsequent magnetic separation, i.e., sorting, of the product, both as described hereinbelow.

As described hereinbelow, the rapid solidification manufacturing techniques produce a distribution of morphology fractions within the same melt spins. Even the manufacturing techniques described herein provide a range, albeit a narrower range of morphologies. However, using the sorting techniques described hereinbelow and in the commonly copending U.S. application Ser. No. 063,936 filed June 19, 1987 by John E. Keem and Jun Su Im for Method OF Manufacturing, Concentrating AND Separating Enhanced Magnetic Parameter Materials From Other Materials, the disclosure of which is incorporated herein by reference, we have collected samples of as produced material in which the crystallite size of samples from the same ribbon was larger than, the same as, and smaller than the material specific characteristic crystallite dimension, $R_o$.

SYNTHESIS

A. Subatmospheric Pressure Melt Spinning

According to our invention, high yields of fine grain particulate material having a narrow distribution of morphologies, e.g., crystallite sizes, are obtained by the controlled pressure, e.g., subatmospheric pressure rapid solidification method of the invention. In the case of ferromagnetic alloys of the 2-14-1 type, this method provides a particulate product containing a very high fraction, e.g., at least about 40 weight percent, and even 60 or more weight percent ferromagnetic alloy material having the morphologies identified with enhanced magnetic parameters. In the case of heterogeneous catalysts, as Raney nickel catalysts, this method provides a particulate product having the morphologies identified with high catalytic activity.

According to this preferred exemplification, the precursor alloy is solidified under subatmospheric pressure conditions to produce a particulate, i.e., flake, product rich in the desired morphology and parameters. While not wishing to be bound by this explanation, it is possible that the low pressure helps control convective heat transfer from the metal to the gas, thereby providing more precise control of the uniformity of the heat transfer rate, and/or that the low gas pressure reduces the tendency towards formation of thermally insulating gas films between the solidifying metal and the chill surface, and/or that the low pressure allows dissolved gases to be exsolved.

According to the method of our invention, a supply of the molten precursor is formed in a vessel in proximity to the chill surface, and a stream of the molten precursor is ejected from the vessel, through a subatmospheric pressure environment, typically comprising a non-reactive gas, onto a rapidly moving chill surface. The molten stream impinges onto the chill surface in the subatmospheric pressure environment causing the quenched material, e.g., a discontinuous stream of particles and flakes of the alloy, to be thrown off of the rapidly moving chill surface. These particles travel through the subatmospheric pressure environment and are recovered as a fine crystallite size alloy having a high fraction of material with a crystallographic size distribution closely distributed about a mean size.

The non-reactive gas used to provide the controlled pressure, e.g., a subatmospheric pressure gas, is typically an inert gas of hydrogen, and is chosen from the group consisting of helium, argon, hydrogen, and mixtures thereof. Preferably, the gas is argon. Generally when the gas is argon, the subatmospheric pressure is below about 200 to 400 millimeters of mercury, absolute. It is to be understood that each of the aforementioned gases as well as mixtures thereof will have a unique optimum gas pressure for specific sets of hydraulic parameters, which pressures may be readily determined from the principles described herein utilizing standard chemical and mechanical engineering procedures by one of ordinary skill in the art.

A further aspect of process control is maintaining the molten precursor quiescent in the vessel in order to reduce transients in the ejection pressures. This may be accomplished, for example, by indirectly heating the molten precursor, as by indirectly inductively heating the molten precursor. Thus, in one embodiment the molten precursor is heated with an electrical field that is electrically decoupled from but thermally coupled to the molten precursor. This maintains the precursor both molten and substantially quiescent.

Figure 2:
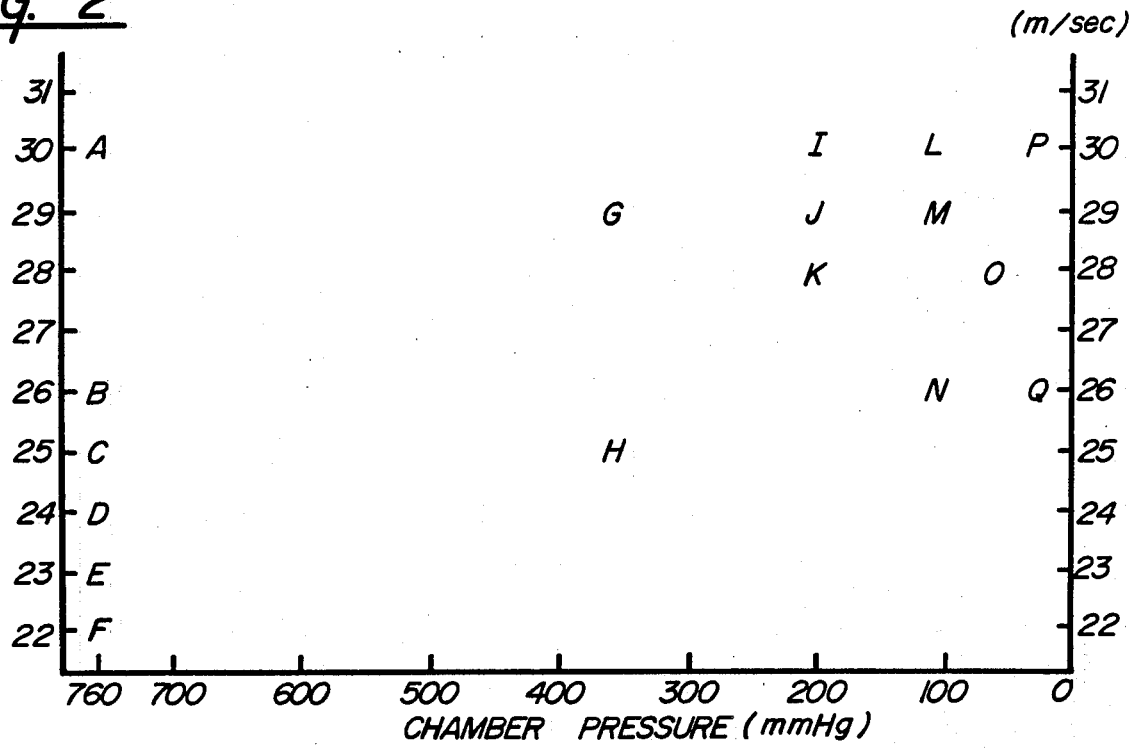
Figure 3:
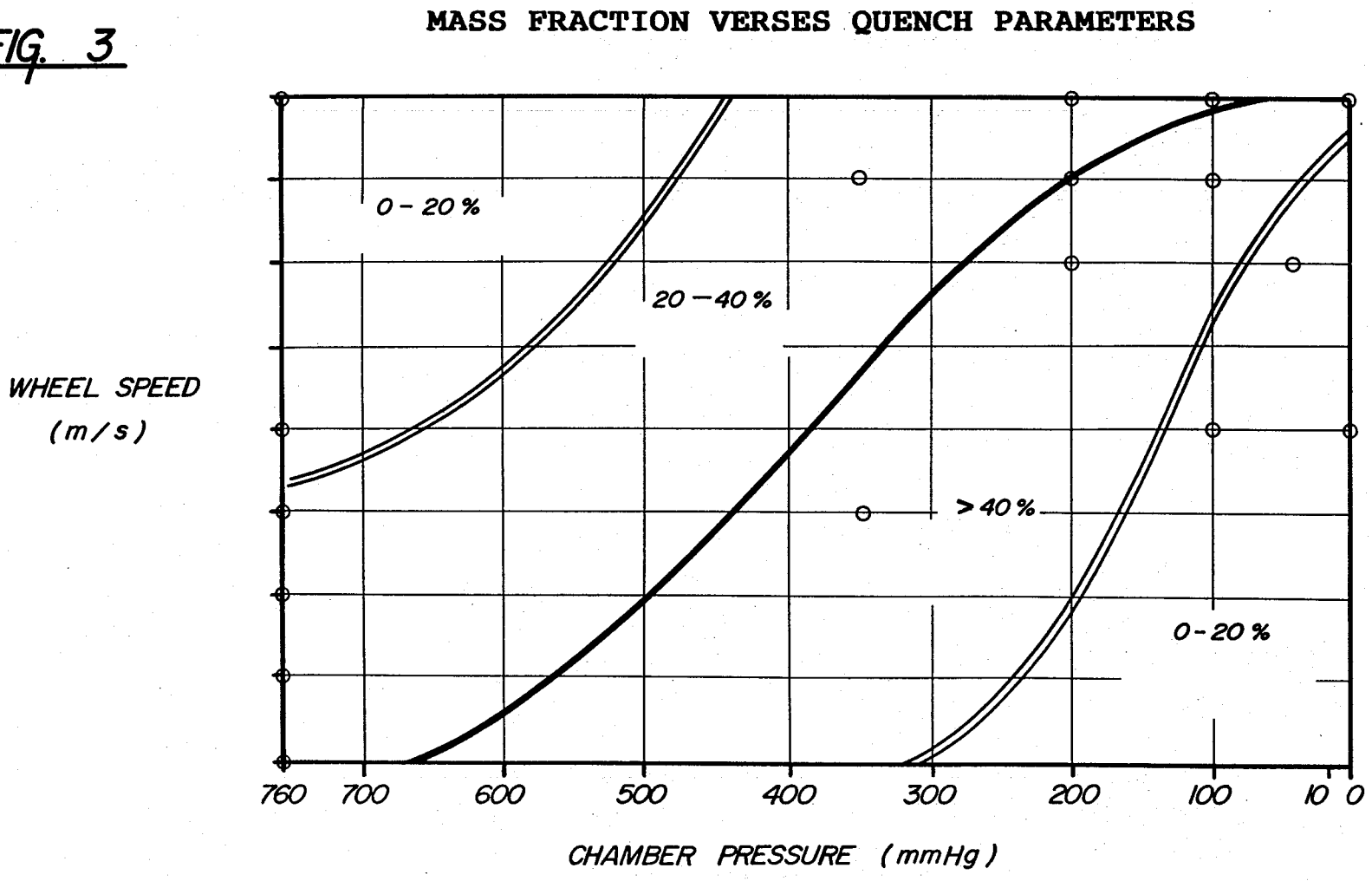
FIG. 3 is a graphical representation of the yield above about 15 megagaussoersteds versus Wheel Speed and Pressure for Sample 539AA of Example I.
Figure 4:
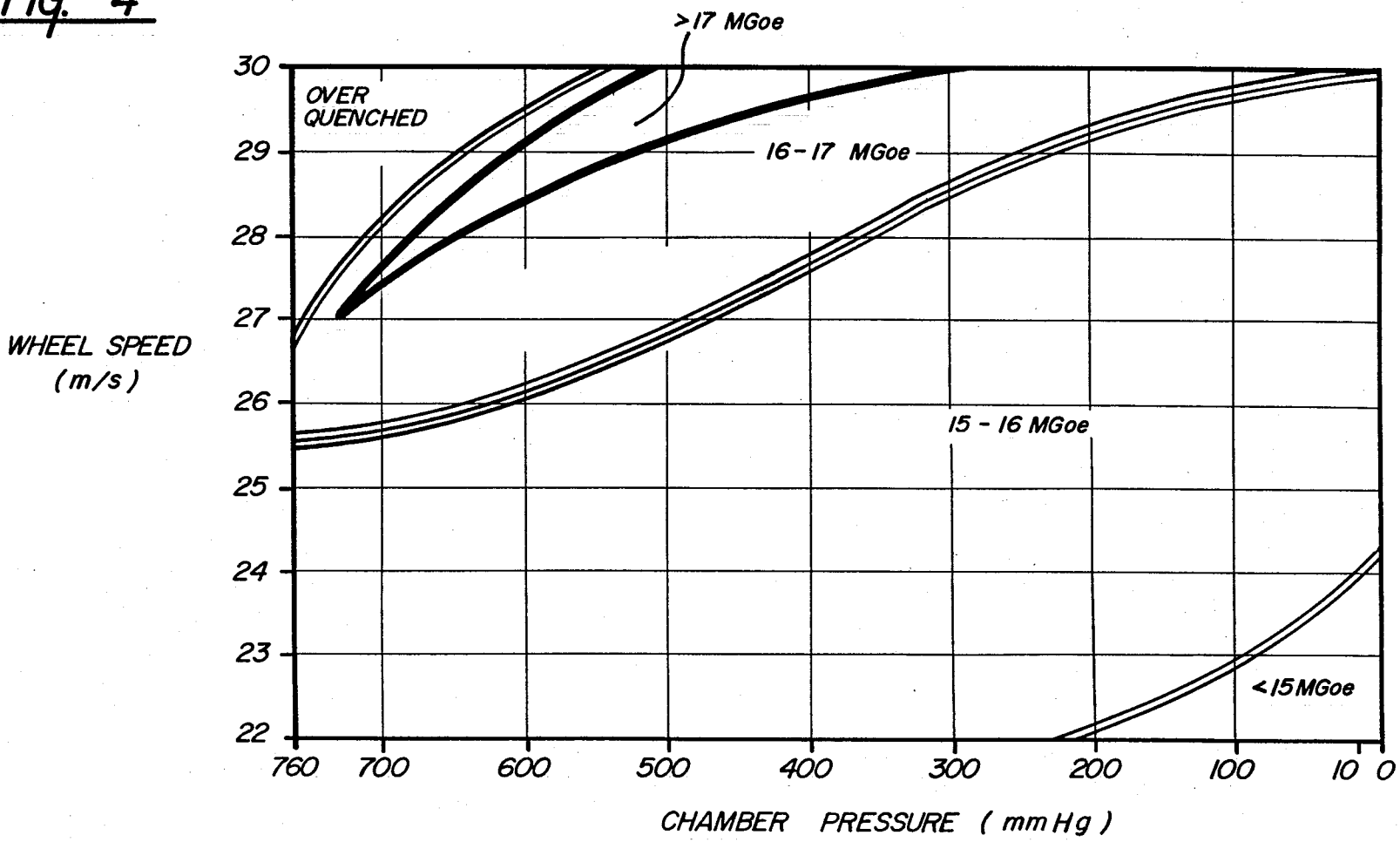
FIG. 4 is a graphical representation of the Maximum Magnetic Energy Product versus Wheel Speed and Pressure for Sample 539AA of Example I.

FIG. 2 is a map of the data for magnetic parameters versus Wheel Speed and Chamber Pressure for 2-14-1 type ferromagnetic materials prepared by the method of the invention. FIGS. 3 and 4 show the projected complete response surfaces for Yield and Energy Product respectively versus Wheel Speed and Pressure for one alloy (Alloy Sample 539AA, Example I) at one set of ejection pressure, orifice diameter, and chill surface wheel diameter parameters.

FIG. 3 shows the projected complete mapping of Mass Fraction of material having a magnetic energy product above 14.7 megagaussoersteds versus Wheel Speed and Pressure. FIG. 3 clearly shows a region of parameter space where the mass fraction above about 14.7 to 15 megagaussoersteds, a bench mark for the onset of interaction in the "2-14-1" system, is maximized. Generally, the fractions of ferromagnetic alloy materials had a bimodel distribution of magnetic parameters, one fraction having a maximum magnetic energy product several kiloOersteds below 14.7 to 15 KOe, and the other fraction having a magnetic energy product above about 15 KOe. This region is seen to increase with reductions in pressure and increases in wheel speed.

FIG. 4 shows the projected complete mapping of Maximum Magnetic Energy Product of the highest maximum magnetic energy product fraction recovered versus Wheel Speed and Pressure. The maximum energy product is a function of at least wheel speed and pressure.

FIG. 4 shows that there is a threshold pressure and that pressures must be maintained below this threshold pressure (which is a function of at least, e.g., orifice diameter, orifice to wheel spacing, and material properties) to obtain the desired narrow grain size distribution.

In the case of Sample 539AA, illustrated in FIGS. 2, 3 and 4, and described in Example I, the threshold pressure is 700 mm Hg absolute (i.e., minus 60 mm Hg gauge). At pressures above about 600 mm Hg to 700 mm Hg absolute, the highest values of energy product are not obtained. These highest values are only obtained below 600 mm Hg to 700 mm Hg absolute for the orifice diameters, orifice to wheel distances, and orifice pressures utilized in Example I. Generally, the best results are obtained at chamber pressures below about 300 mm Hg to 400 mm Hg absolute, and preferably below about 200 mm Hg to 400 mm Hg. However, it is to be understood that threshold pressures for other sets of parameters may be determined by routine experimentation utilizing the principles described herein.

As shown in FIGS. 3 and 4, there is a large region in Wheel Speed-Pressure parameter space that reproducibly produces in excess of 40 mass percent of enhanced parameter material with a pellet energy product greater than 14.7 megagaussoersted. This region of parameter space, for the material of Example I, (laboratory sample 539AA), at a fixed ejection pressure across the crucible of 2 pounds/square inch, an orifice diameter of 0.075 centimeter, and a wheel diameter of 20 inches, is mapped by $$30-[8/320]Pc \leqq Vs \leqq 30-[8/160]Pc$$

where Pc is the Chamber Pressure in millimeters of mercury and Vs is the Wheel Speed in meters per second.

The projected complete response surface, especially the maximum magnetic energy product of the highest energy product fraction as a function of pressure and of wheel speed, is shown in FIG. 4.

We have also found that the Wheel Speed at the pressures we have investigated should be in the range of 20 to 30 meters/second, and preferably about 20 to 25 meters/second, depending on the chamber pressure.

The process allows a degree of process control where the components of quench associated with (1) forced convective cooling by the argon gas at the free surface of alloy, and (2) conduction to the chill surface may be individually controlled.

The process has been studied and engineered for a narrow range of crucible orifice diameters, crucible pressures, crucible orifice to chill wheel spacings, and inert gas compositions. However, modifications thereof are matters of routine experimentation within the scope of the concept described herein, and may be readily accomplished.

B. Apparatus For Subatmospheric Pressure Melt Spinning

Figure 5:
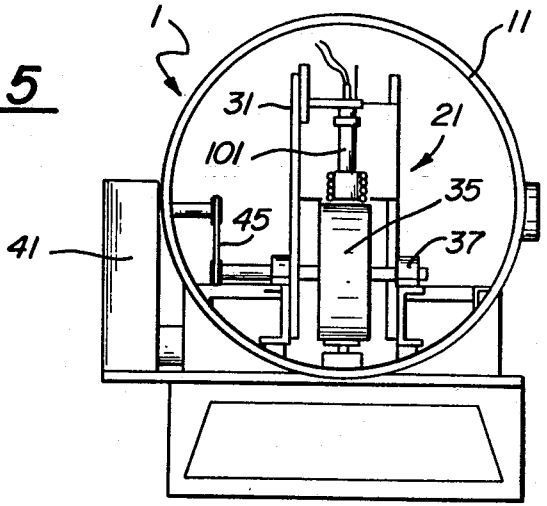
FIG. 5 is a side elevation view, in cutaway, of a melt spinner useful in the practice of the invention.
Figure 6:
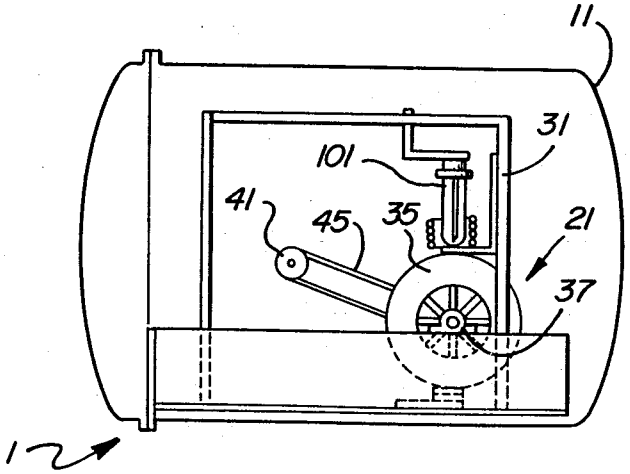
FIG. 6 is a cutaway view of the melt spinner of FIG. 8.
Figure 7:
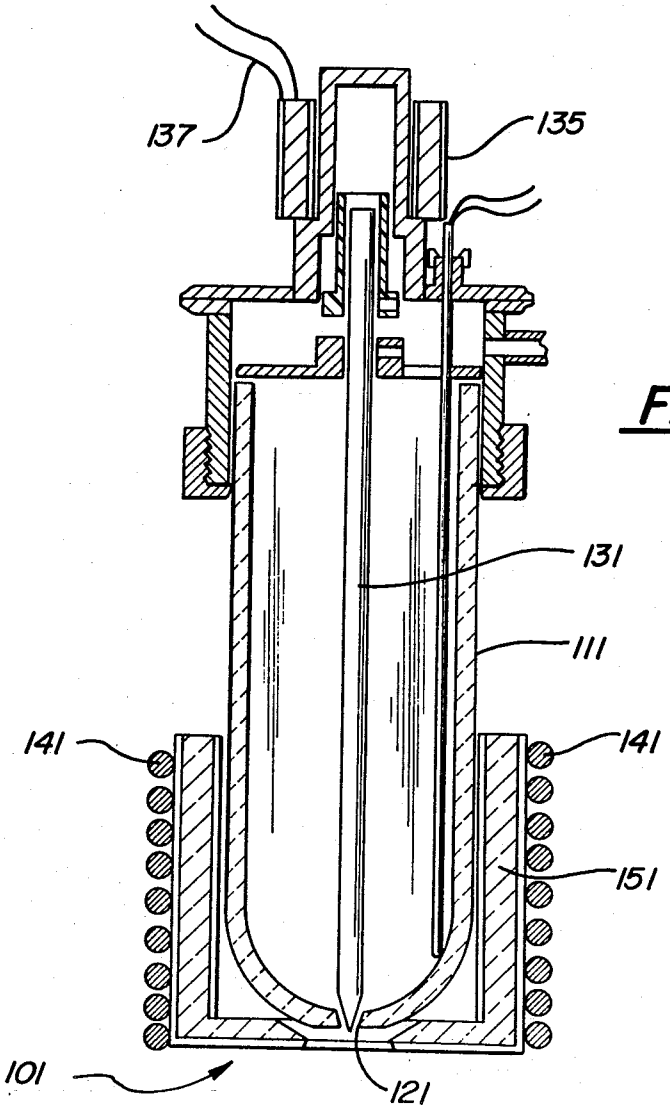
FIG. 7 is a cutaway view of the crucible assembly.

Apparatus useful in subatmospheric pressure melt spinning of fine grain materials according to the method of the invention is shown in FIGS. 5, 6, and 7. FIGS. 5 and 6 show a melt spinner 1. The melt spinner includes a pressure vessel 11. Within the pressure vessel 11 is a melt spinning assembly 21. This assembly provides a substantially vibration free support for the melt spinning wheel 35 and a ball bearing shaft 37. The shaft 37 and the melt spinning wheel 35 are driven by motor 41, e.g., through pulleys 45.

Positioned above the wheel 35, and in proximity thereto is a crucible assembly 101. As shown in FIG. 7, the crucible assembly 101 includes a crucible 111, for example, a mullite or quartz crucible 111 with an orifice 121 in proximity to the melt spinning wheel 35.

As shown in FIG. 7, a plug rod 131 is provided to controllably open the orifice 121 and allow the flow of molten alloy from the crucible 111. The plug rod 131 is controllably opened by a solenoid coil 135 with a power supply.

The crucible 111 and alloy contents are heated, e.g., by an induction heating coil 141. Normally induction heating provides vigorous mixing in the molten alloy. This mixing and turbulence has an adverse effect on the instantaneous quench parameters. We have found, however, that if induction heating is utilized with an electric field, i.e., in the coils 141, that is electrically decoupled from the molten metal, but thermally coupled thereto, as by a supceptor 151, indirect heating of the melt is obtained, e.g., indirect inductive heating, and in this way a quiescent melt is obtained in the crucible 111.

The combination of (1) a quiescent melt, as obtained, for example by indirect inductive heating, with an electric field that is electrically decoupled from but thermally coupled to the molten alloy, as by supceptor 151, (2) a high wheel speed, e.g., above about 20 to 25 meters per second, and (3) a low environmental pressure, e.g., below about 700 mm Hg absolute, and preferably between about 200 to 400 mm Hg absolute, provides a high yield of enhanced parameter material.

C. Experimental Results With $RE_2Fe_{14}B$ Type Alloy

Low pressure melt spinning has resulted in the production of a "2-14-1"—type ferromagnetic alloy having a $P4_2/mnm$, tetragonal crystallography, and enhanced permanent (hard) magnetic parameters. A further advantage of the low pressure method that we have observed is the ability to produce an iron rich, ferromagnetic 2-14-1 type alloy that is both rich in iron, and substantially free of soft magnetic, cubic iron phases (i.e., alpha iron) at iron concentrations where magnetically significant cubic iron phases have been reported by others. That is, utilizing the method of our invention it is possible to obtain a "2-14-1" type ferromagnetic alloy that is hyperstoichiometric in iron, or iron and cobalt, i.e., containing in excess of 85 atomic percent iron or iron and cobalt, and consequently less than 10 atomic percent rare earth, has magnetic parameters exceeding these of conventional, non-interactive materials, and behaves as a magnetically single phase material.

The quench parameters obtained through the use of low pressures and high wheel speeds results in very high yields of enhanced parameter ferromagnetic alloy material, e.g., above about 40 weight percent and even above about 60 or more weight percent material exceeding prior art, i.e., the Stoner and Wohlfarth upper limits for non-interactive ferromagnetic materials, and above 10 to 20 weight percent of ferromagnetic 2-14-1 type materials having magnetic energy product above 17 megagaussoersteds.

IV. INTEGRATED PROCESS WITH MAGNETIC SORTING

While the method of the invention significantly increases the yield per run of enhanced parameter material, it is to be understood that in practice, fluctuations in the rapid solidification process conditions result in a distribution of the morphologies in the resulting product. Thus, in the case of ferromagnetic alloys, the product of the rapid solidification process which contains significant quantities of enhanced remanence, high energy product material may still be diluted by lower energy product material. In the practice of our invention, the benefit of the higher yield enhanced performance fraction may be more fully realized by the concentration of the enhanced magnetic parameter material using a magnetic separation procedure as described in commonly assigned, copending U.S. application Ser. No. 063,936, filed June 19, 1987, in the names of John Keem and Jun Su Im for Method OF Manufacturing, Concentrating, AND Separating Enhanced Magnetic Parameter Material From Other Magnetic Co-Products specifically incorporated herein by reference.

According to a particularly preferred exemplification of the invention, the subatmospheric pressure method of rapid solidification is followed by a sorting process to separate "overquenched" and "underquenched" factions, thereby providing a "cut" of enhanced parameter material. The sorted and separated "cut" of enhanced parameter material may have a very narrow morphological and parametric distribution, and be substantially free of either or both of (1) very fine crystallite size, low coercivity, low energy product, "overquenched" material and/or (2) very large crystallite size, low remanence, low energy product, "underquenched" material.

FIG. 8 shows an integrated, two step process. In the first step of the two step process, the herein described low pressure rapid solidification process is utilized to synthesize a flake-like or plate-like, brittle, magnetic alloy with a narrow crystallite size distribution about a mean crystallite size. The flakes are recovered and separated into enhanced parameter and low energy product factions by magnetic sorting. The low energy product fractions may be remelted, heat treated, or even used directly.

This integrated, two step process relies on the surprising observation, shown quantitively in FIG. 9, that the energy product of all of the performance fractions is substantially inversely related to the magnitudes of the initial (i.e., low applied magnetizing field) magnetizations of those fractions.

According to the alternative method of the invention utilizing a subsequent sorting step, a magnetic field is applied to the particulate solid or classified portion thereof. The magnetic field has a low enough field strength (H* in FIG. 9) to avoid substantial magnetization of an enhanced energy product fraction but high enough to effect induced magnetization of low energy product fraction. The lower energy product fraction will be magnetized and attracted to the magnetic separator, while the higher energy product fraction will be left behind. This step may be stepwise repeated with higher applied magnetic fields until all of the particulate solid has been classified according to energy product.

We have found and described in commonly assigned co-pending application Ser. No. 063,936, above, that in order to effect separation on the basis of energy product differences in materials of the 2-14-1 type (1) the distance between the electromagnet and the particles and (2) the magnetization in the electromagnet (magnetic separator) should be such as to obtain separation. This can be readily determined, empirically, for any actual system. Values above the empirically determined range may magnetize too many enhanced parameter flakes and particles, resulting in clumping, agglomerating, and failure to attain separation. Values below this empirically determined range do not remove low parameter flakes and particles.

The underquenched, coarse grain material may be utilized as a low energy product commodity, or recycled, i.e., remelted. The fine grain, overquenched material may be utilized as a low energy product commodity, recycled (i.e. remelted), or heat treated to increase the grain size.

This difference in induced magnetization allows mechanical separation of a first portion primarily composed of "enhanced parameter" particles, and magnetic separation of "overquenched" low complete magnetization magnetic property particles.

"Magnetic separation" as used herein means the separation, i.e., sorting, of materials based on a difference in magnetic characteristics, referred to generally as "magnetic attractability". "Magnetic attractability" is defined and described in Warren L. McCabe and Julian C. Smith, *Unit Operations of Chemical Engineering*, McGraw Hill Book Company, Inc., New York, (1956), at pages 388–391, incorporated herein by reference.

A method of magnetic separation, useful in practising the invention herein, is to place an electromagnet close to the particulate material. Materials of low induced magnetized are not attracted to the electromagnet, while materials of relatively higher induced magnetization are collected on the face of the electromagnet.

V. MAGNETIC ALLOY COMPOSITIONS

The magnetic materials which may be fabricated by the method of the invention are ferromagnetic alloys of ferromagnetic transition metals, e.g., Fe, Co, and Ni, with other metals, as rare earth metals. In one exemplification the magnetic alloy material is an alloy of iron, optionally with other transition metals, as cobalt, a rare earth metal or metals, as neodymium, or praseodymium, optionally with lanthanum, boron, and, optionally, a modifier. In another exemplification the magnetic alloy material is an alloy of a ferromagnetic transition metal as iron or cobalt, with a lanthanide, as samarium, and, optionally, a modifier.

Exemplary modifiers are silicon, aluminum, and mixtures thereof. The amount of modifier, when present, is at a level, in combination with the quench parameters, to give the above described isotropic magnetic parameters morphologies.

The magnetic alloy may be of the type [Rare Earth Metal(s)]-[Transition Metal(s)]-Boron-[modifier(s)], for example [Nd,Sm]-[Fe, Co]-[Si, Al].

Another interacting alloy may be of the type [Rare Earth Metal(s)]-[Transition Metal(s)]-Boron-[modifier(s)], for example [Rare Earth Metal(s)]-[Fe,-Co]-Boron-[modifier(s)], and [Rare Earth Metal(s)]-Fe,Co,-Mn]-Boron-[modifier(s)].

The magnetic alloy material may be of the $RE_2TM_{14}B$ type, also equivalently referred to in the art as the $Nd_2Fe_{14}B$ —type, the 2-14-1 type, and/or the tetragonal $P4_2/mnm$ type. This class of materials has the stoichiometry represented by:

$$(Fe,Co,Ni)_a(Nd,Pr,Ln)_bB_c(Al,Si)_d,$$

exemplified by $Fe_a(Nd,Pr,Ln)_bB_c(Al, Si)_d$, where a, b, c, and d represent the atomic percentages of the components iron, rare earth metal or metals, boron, and a modifier as silicon and/or aluminum, respectively, and $a+b+c+d=100$;

a is from 75 to 85;

b is from 10 to 20, and especially from 11 to 13.5;

c is from 5 to 10;

and d is an effective amount, when combined with the particular solidification or solidification and heat treatment technique to provide a distribution of crystallite size and morphology capable of interaction enhancement of magnetic parameters, e.g., from traces to 5.0. Ln is a lanthanide, such as La, that may be present in addition to the Nd, Pr, or both.

Under certain quench conditions attainable utilizing the low pressure rapid solidification method of the invention, concentrations of the transition metal greater than 85 atomic percent can be provided in the 2-14-1 type structure. The transition metals may be present within the 2-14-1 type phase at levels above the normal stochiometric and solubility limits of Fe and/or Co in the 2-14-1 type phase, i.e., the excess Fe and/or Co is not in an exsolved transition metal phase, as an exsolved cubic iron phase in the case of excess iron. This allows for a larger number of transition metal electrons (capable of ferromagnetic spin alignment) then would heretofore be expected from equilibrium solidification and thermodynamic considerations. The extremely rapid solidification of an Fe and/or Co rich, rare earth lean, tetragonal, $P4_2/mnm$ material, allows the transition metal stoichiometric coefficient a to be above 85, e.g., up to 88.5 or more, and the rare earth metal stoichiometric coefficient b to be below 10, e.g. as low as 8. These materials can be synthesized, without deleterious exsolvation of the Fe and/or Co into magnetically significant second phases, by the low pressure rapid solidification process described hereinbelow.

The rare earth metal is a lanthanide preferably chosen from neodymium and praseodymium, optionally with other lanthanides (one or more of La, Ce, Sm, Eu, Gd, Tb, Dy, Ho, Er, Tm, Yb and Lu), Sc, Y, and mixtures thereof present. While various combinations of the rare earth metals may be used without departing from the concept of this invention, especially preferred rare earth metals are those that exhibit one or more of the following characteristics: (1) the number of f-shell electrons is neither 0 (as La with zero f orbital electrons), 7 (as Gd with 7 f orbital electrons) or 14 (as Lu with 14 f orbital electrons), (2) low molecular weight lanthanides, such as La, Ce, Pr, Nd, and Sm, (3) lanthanides that couple ferromagnetically with iron, as Nd and Pr, or (4) relatively inexpensive lanthanides, as La, Ce. Pr, and Nd. Especially preferred lanthanides are Nd and Pr. Various commercial and/or byproduct mischmetals may be used. Especially preferred mischmetals are those rich in Nd and/or Pr, optionally with small amounts of lanthanum.

VI. HETEROGENEOUS CATALYSTS

Many catalysts, as consolidated Raney nickel catalysts, show a bimodal pore size distribution, sometimes termed a bidisperse structure, or macro-micro distribution. This is the case, for example, for most pelletized, extruded, deposited, agglomerated, or sintered Raney nickel catalysts. One finds a "fine" pore structure within each of original particles of the Raney nickel and a "coarse" pore structure around the original particles of the Raney nickel. The diffusion mechanism between and around the particles is bulk diffusion, while the diffusion mechanism within the particles may be either bulk diffusion or Knudsen diffusion.

For many chemical reactions of industrial importance, overall reaction rate is increased when the catalyst has a substantially uniform internal pore size, characterized by a narrow pore size distribution about a mean pore size. This is especially true for pore sizes giving rise to Knudsen flow within the internal pores. According to one exemplification of our invention it is possible to obtain a porous catalyst having a substantially uniform fine pore size, narrowly distributed about a mean pore size.

According to this alternative exemplification of our invention, high yields of fine grain, particulate, catalyst precursor material having a narrow distribution of morphologies, e.g., transition metal crystallite sizes and leachable metal crystallite sizes, with appropriate interconnection of phases to provide the porous catalysts are obtained by the controlled pressure, e.g., subatmospheric pressure rapid solidification method of the invention described hereinabove. In the case of Raney alloys, this method provides a particulate multiphase product containing uniformly fine transition metal rich regions and uniformly fine leachable regions.

According to this preferred exemplification, the precursor alloy, e.g., of a transition metal such as Ni and/or Fe, preferably Ni, and a leachable material, as Zr and/or Al, and preferably Al, optionally with other materials, is solidified under subatmospheric pressure conditions to produce a particulate, i.e., flake, product rich in the desired morphology and parameters. While not wishing to be bound by this explanation, it is possible that the low pressure helps control convective heat transfer from the metal to the gas, thereby providing more precise control of the uniformity of the heat transfer rate, and/or that the low gas pressure reduces the tendency towards formation of thermally insulating gas films between the solidifying metal and the chill surface, and/or that the low pressure allows dissolved gases to be exsolved.

According to the method of our invention, a supply of the molten transition metal-leachable material precursor is formed in a vessel in proximity to the chill surface, and a stream of the molten precursor is ejected from the vessel, through a subatmospheric pressure environment, typically comprising a non-reactive gas, onto a rapidly moving chill surface. The molten stream impinges onto the chill surface in the subatmospheric pressure environment causing the quenched material, e.g., a discontinuous stream of particles and flakes of the alloy, to be thrown off of the rapidly moving chill surface. These particles travel through the subatmospheric pressure environment and are recovered as a fine crystallite size alloy having a high fraction of material with a crystallographic size distribution closely distributed about a mean size.

The particulate product of the subatmospheric pressure rapid solidification process, containing uniformfine grain regions of transition metal and uniform fine grain regions of leachable material are then leached, e.g., in aqueous alkaline medium, as aqueous potassium hydroxide or aqueous sodium hydroxide, so as to remove the leachable material, leaving behind a porous catalytic solid network of substantially uniform diameter pores.

EXAMPLES

The invention may be understood by reference to the following examples utilizing the method of the invention for the synthesis of enhanced parameter materials.

The examples reported herein below are arranged in two examples. The first example illustrates the high yields, both mass percent of enhanced parameter material, and maximum magnetic energy product of a highest energy product fraction, as a function of chamber pressure and wheel speed, where magnetic separation, i.e., sorting has been used to effect separation of fraction. The second example demonstrates the broad compositional range (greater than the equilibrium stability range for 2-14-1 type materials) over which enhanced parameter magnetic materials can be synthesized by the method of the invention. The compositional range exceeds the predictions of the prior art, and is an advantageous result of the methods described herein.

A. SUMMARY OF TESTS

In obtaining the results in the following examples, a macroscopically homogeneous ingot was first prepared by melting together the proper mixture of iron, neodymium, praseodymium, other rare earths, boron, silicon, and aluminum. Thereafter, portions of each ingot were melted and rapidly quenched using melt-spinning to form fragments of ribbon. The ribbon segments were then separated into high and low parameter fractions by a magnetic separation process. The separated segments were then pelletized for testing.

In the following examples, individual samples are designated by a code comprising a three digit number, two letters, a number and, optionally, a number in parenthesis. The first three digits are the alloy number of the original ingot. The two letters identify the individual melt spin run numbers from that ingot. The numbers in parenthesis are the individual flake numbers, and are used only for flake samples, and not for pellet samples.

B. PREPARATION OF THE BULK INGOT

The precursor alloys were generally prepared from the elemental components: iron (99.99% pure electrolytic iron flake), ferroboron boron (99.7% crystalline boron), Nd and Pr pure rods (99.9% rare earth metals), and silicon (99.99% Si crystals). In some cases, higher purity material was used. In other cases, commercial-grade rare-earth products were used, containing up to 15 weight percent iron and up to several weight percent of rare earths other than Nd and Pr. In addition to elemental boron, a ferroboron material containing 18 weight percent boron and the remainder iron was used as a source of boron.

The components were weighed out in the appropriate proportions and melted together to form a homogeneous bulk ingot by vacuum induction melting. The samples were melted under a partial pressure of argon in either quartz or magnesia crucibles. They were taken to a temperature above 1400 Centigrade and held for thirty minutes with agitation to obtain a homogeneous ingot. After solidifying and cooling, the ingot was recovered from the crucible, an outer skin of reaction product was removed, and the ingot broken up into particles suitable for melt spinning. Composition checks were made on samples of the ingot material to check for homogeneity.

C. PREPARING THE QUENCHED RIBBON

Preparing the quenched material from the ingot was performed in a subatmospheric pressure melt-spinning system. The system includes a vacuum vessel with a copper wheel twenty inches in diameter, four inches wide and three inches thick. The vacuum chamber was evacuated, and thereafter pressurized with an inert atmosphere to a pre-set subatmospheric pressure.

The crucible was a mullite cylinder 44 mm inside diameter 52 mm outside diameter by about 26 cm long, with a 54 mm inside diameter, 66 mm outside diameter, 11 cm long graphite receptor surrounding the crucible, between the crucible and the induction coils. The crucible orifice was typically a circular hole in the crucible bottom, between 0.5 and 1.5 mm in diameter, and the crucible was positioned with the orifice 15 to 30 mm from the wheel surface.

Several chunks of ingot alloy were melted in the crucible using a 10 kHz induction heater until the desired temperature (typically of order 1300–1500 degrees C.) was reached, as determined using an optical pyrometer and an immersible B-type thermocouple. During heat up of the crucible and melting of the alloy the crucible was sealed with a removable seal. When a pre-determined temperature was reached, argon pressure was provided to the melt and the seal was removed by an AC induction activated solenoid, unsealing the orifice and forcing a jet of molten metal through the orifice onto the rotating wheel. The ejection continued until the crucible was empty, or alternatively until the orifice clogged.

The low pressure method of rapid solidification of the invention was seen to provide both (1) better control of the mean crystallite size, and (2) a narrower distribution of crystallite sizes about this mean then did atmospheric pressure rapid solidification.

D. MAGNETIC SEPARATION

A laboratory electromagnet was built for the magnetic separation. The laboratory electromagnet utilized a 3 centimeter long by 3 centimeter diameter iron bar wrapped with 200 turns of 26 AWG copper wire. The power supply to the electro-magnet was a 10 volt-1 ampere D.C. power supply.

Particle fragments, prepared as described above, were separated by sieving into a minus 60 mesh (250 micron) fraction, a minys 160 mesh plus 60 (100 micron to 750 micron) fraction, and a plus 150 mesh (100 micron) fraction. The 150 to 250 micron fraction was then separated into enhanced magnetic parameter and low magnetic parameter fractions. After energizing the electromagnet, the low magnetic parameter flakes were drawn to the electromagnet and the enhanced parameter flakes were left behind in the first pass. Approximately 90 percent of flakes left behind had an energy product greater than 15 MGOe.

Magnetic separation can be carried out sequentially, with increasing magnetic field, H, on each pass. In this way the demarcation between the materials having relatively high magnetic parameters at substantially complete magnetization (and left behind by the weak magnetic field used for the separation) and the material having relatively lower magnetic parameters at substantially complete magnetization (and removed by the weak magnetic field used for the separation) was increased on each succeeding pass with increasing magnetic field, H. FIG. 5 of commonly assigned copending U.S. application Ser. No. 063,936 of John E. Keem, et al hereby specifically incorporated herein by reference clearly shows this result.

D. PELLETIZATION

The flakes where ball milled under an inert (Argon) gas atmosphere using nickel balls in glass containers. The resulting powder was sieved to select particles 50 micrometers to 250 micrometers in size. The powder was then loaded into one of the dies of a number of cylindrical steel punch and die sets. The punches ranged from 1 mm to 8 mm in diameter. Cylindrical pellets were pressed at approximately 25 to 300 kpsi resulting in green pellets with a density of between 5.8 g/cc and 6.2 g/cc (76% to 81.5% of 7.6 g/cc, the density of the stoichiometric 2-14-1 phase). After pressing, the green pellets were weighed on a Mettler H-80 automatic electrobalance calibrated to 0.1 milligram accuracy. The green pellets were then placed in vials of impregnating adhesive (e.g., Loctite 609). After a few minutes, the pellets were removed from the vials, and the excess adhesive was removed. The pellets were then cured in a vacuum oven at a pressure of less than 10 mm Hg and a temperature of 50° C. to 90° C. for 10 to 15 minutes. The bonded magnets produced in this way contain approximately 3 wt. % adhesive, and were 2.95 mm in diameter and from 3.12 to 3.30 mm long.

E. MAGNETIC MEASUREMENTS

Measurements of magnetic properties were made using a Model 9500 computer-controlled vibrating-sample magnetometer (VSM) manufactured by LDJ, Inc., having a maximum applied magnetic field of 22 kOe. The values of magnetic field H were determined under feedback-control with a calibrated Hall probe. The measurement software was modified in-house to permit measurement of both major and minor hysteresis loops of permanent magnet materials with high coercive forces. Before every set of measurements, the calibration of the magnetization M was checked using a standard (soft magnetic) nickel sphere (from the U.S. National Bureau of Standards) of measured weight. The calculation of the magnetization of the magnetic materials required a measurement of the sample mass of order 0.12 to 0.15 gram for a typical pellet using a Cahn-21 automatic electrobalance (with precision to 1 microgram), and an estimate of the density.

The measurement was carried out by ramping the field from zero to a maximum magnetic field, typically 22 kOe, through zero again to a negative maximum, and then back through zero to the positive maximum again, while the entire hysteresis loop was recorded, i.e., magnetization M vs. applied magnetic field H. The program then determined the chief magnetic parameters: the remanent magnetization or remanence Br (the positive y-intercept of the hysteresis curve), measured in units of kilogauss, the intrinsic coercive force or coercivity $H_{ci}$ (the negative x-intercept of the hysteresis curve), measured in units of kiloOersteds, and the maximum energy product (the maximum negative value of the product of the induction $B=H+M$ and field H), measured in units of megagaussoersteds.

The applied field of 22 kOe was sufficient to "close" the hysteresis loops.

For measurements of the magnetizations of the bonded magnets in the VSM magnetometer a correction for the demagnetization field was made to the applied field to obtain the magnetization as a function of the internal field. These corrections are described in R. M. Bozorth, *Ferromagnetism*, p. 846, (Van Nostrand, New York, 1951) and B. D. Cullity, *Introduction To Magnetic Materials*, Section 2.6 (Addison-Wesley Publishing Co., Reading, Mass. 1972), both of which are hereby specifically incorporated by reference herein. The equation for the correction is:

$$H_{int}=H_{app}-NM$$

where $H_{int}$ is the field inside the material, $H_{app}$ is the externally applied field, M is the magnetization of the material measured at the applied field and N is the demagnetizing factor which simulates the influence of the field produced by the material on itself. The demagnetizing factors used ranged between 0.25 and 0.37 depending on the dimensions of the pellet and its orientation with respect to the applied field.

H. SATURATION MAGNETIZATION

A saturation magnetization range of 15.26 kilogauss (Sample 556AA02) to 16.2 kilogauss (Samples 561AA02 and 561AA03) was used for the calculation of (1) the remanence ratio, ($Mr/M_{sat}$), and (2) the ratio of Energy Product to $(M_{sat/4})^2$. The saturation magnetization was determined from measurements made at the Francis Bitter National Magnet Laboratory utilizing a procedure described in J. E. Keem, G. B. Clemente, A. M. Kadin, and R. W. McCallum, *Magnetism Of HiRem Materials*, presented Oct. 12, 1987 at ASM Materials Week, which is hereby specifically incorporated herein by reference.

EXAMPLE I

539AA Series

The samples in this Example illustrate a synthesis procedure which produces high mass yields of interactive material. This Example shows the effect of Wheel Speed and Chamber Pressure on:

(1) The fraction of product having an energy product above about 15 MGOe.

(2) The average energy product of the portion having an energy product above about 15 MGOe.

The 539AA ingot from which the twenty melt spins described in the Example were made was produced by vacuum induction melting as described in Section B above. The bulk chemical analysis on the ingot gave the composition shown in Table I-1.

The ribbons were spun on the above described 20 inch diameter melt spinner at Wheel Speeds ranging from 22 to 30 meters per second, and chamber pressures ranging from 10 to 760 mm Hg (absolute).

The flakes products of each spin were separated into enhanced parameter and conventional parameter fractions using the magnetic separation procedure described above. The separated flakes were then pelletized as described above. The magnetic parameters of the pellets were then measured. These measurements are shown in FIG. 2, and Table I of this Example. The trend lines of these measurements are shown in FIGS. 3 and 4.

FIG. 3 is a plot of the mass fraction of material above about 15 megagaussoersteds versus Wheel Speed and Pressure. To be noted in that there is a range of Wheel Speed and absolute Pressure that produces a local maximum in the yield of material about 15 megagaussoersteds. This is mapped by the empirical relationship $$30-[8/320]P_c\ V_s\ 30-[80/160]P_c$$

FIG. 4 is a plot of the magnetic energy product of the enhanced parameter fraction as a function of Wheel Speed and chamber pressure. This shows the narrowness of the highest energy product region, and the increasing energy product with Wheel Speed.

While the above runs and data were carried out with a specific orifice diameter, and with argon, it is of course, readily apparent that different orifice diameters, wheel conductivities, and gases will yield similar behavior, but possibly in different regions of Wheel Speed-Pressure parameter space. These different regions of parameter space may be readily determined by the use of standard dimensionless groups and correlations, and experimentally optimized by those of ordinary skill in the art.

EXAMPLE II

The samples of Example II illustrate the applicability of the method to obtain the morphology necessary for enhanced magnetic parameters in lanthanum containing 2-14-1 type materials, in cobalt containing 2-14-1 type materials, in 2-14-1 type materials at low concentrations of Si and/or Al modifiers, and in 2-14-1 type materials that are hyperstoichiometric in Fe and/or hypostoichiometric in rare earth. The ability of the low pressure melt spinning method to produce 2-14-1 type materials that are hyperstoichiometric in Fe, and/or hypostoichiometric in rare earth, and have enhanced parameters is especially surprising in light of the clear teaching in Matsuura, et al, "Phase Diagram of the Nd-Fe-B Ternary System," *Japn. J. Appl. Phys.* 24(8), L635-L637 (August 1985) that such off-stochiometric alloys would contain large amounts of $Fe_{93}B_7$ and/or $E_{87}B_{17}$ type phases. The implication of Matsuura, et al is that materials that are hyperstoichiometric in Fe and/or hypostochiometric in rare earth are magnetically multiphase systems. Magnetically multiphase systems of the type implied by Matsuura, et al would not be expected to have enhanced magnetic parameters as described hereinabove. However, contrary to the explicit and implicit teachings of Matsuura, et al, and as shown in Example II, herein, magnetic materials that are hyperstoichiometric in iron and hypostoichiometric in Nd exhibit significantly enhanced parameters when prepared by the method of the invention.

A series of tests were conducted to determine (1) the effect of the partial substitution of lanthanum for neodymium and/or praseodymium, (2) the threshold concentrations of Al and/or Si required for interaction, (3) the effects of hyperstoichiometric concentrations of iron, i.e., concentrations of iron greater than the levels where precipitation of iron, as intergranular iron, is postulated to occur, and (4) the effects of partial substitution of iron by cobalt, all in ferromagnetic alloys prepared by the method of the invention described herein.

The ingots of iron, praseodymium, neodymium, lanthanum, boron and silicon were prepared following the procedure described in Section B. Preparation OF Bulk Ingot, above. The ingots had an aveerage elemental analysis, in atomic percent by ICP and wet chemistry shown in Table II-1 below.

Fragments of the ingot were then placed into individual mullite crucibles, melted, and quenched to form ribbons as described above. The quench parameters were as shown in Table II-2, below.

The melt spinner product was in the form of flakes which appeared to be comprised of randomly oriented, equiaxed crystallites. The flakes were magnetically separated as described in Section D Magnetic Separation OF THE Quenched Particles, above.

The separated flakes having higher magnetic parameters where then ball milled under an inert (Argon) gas atmosphere and pelletized as described in Section E, Pelletization OF THE Separated Particles, above.

Magnetic properties were measured as described in Section H.2, Magnetic Measurements, Pelletized Product, above. The value of the saturation magnetization used for the calculation of the remanence ratio, ($Mr/M_{sat}$), and (2) the ratio of Energy Product to $(M_{sat/4})^2$, was determined from measurements made at the Francis Bitter National Magnet Laboratory utilizing a procedure described in J. E. Keem, G. B. Clemente, A. M. Kadin, and R. W. McCallum, *Magnetism Of HiRem Materials*, presented Oct. 12, 1987 at ASM Materials Week, which is hereby specifically incorporated herein by reference.

A. LANTHANUM SUBSTITUTION Samples 551AB, 552AB, AND 553AB

The partial substitution of lanthanum for neodymium and/or praseodymium resulted in substantially single phase magnetic materials having macroscopic stoichiometric compositions within the ranges described in U.S. Pat. No. 4,402,770 of Norman C. Koon for *Hard Magnetic Alloys Of A Transition Metal And Lanthanide*. However these materials were magnetically single phase, interactive and exhibited maximum isotropic energy products greater than $(M_{saturation/4})^2$, and isotropic remanences greater than $(M_{saturation/2})$.

B. HYPERSTOICHIOMETRY IN IRON, THRESHOLD CONCENTRATIONS OF AL AND SI

Sample 561AA

Sample 561 had a hyperstoichiometric iron content, i.e., the sample had an iron content above the level at which the prior art teaches that a second, iron rich phase precipitates, i.e., above about 85 atomic percent, a rare earth content below about 10 atomic percent, and did not contain detectable amounts of either Si or Al. The materials of Sample 561AA exhibited enhanced, that is, interactive properties, that is, isotropic energy products above $(M_{sat}/4)^2$ and isotropic remanences above $(M_{sat}/2)$, as shown in Table II-3 below.

C. PARTIAL SUBSTITUTION OF COBALT FOR IRON

Sample 556AA

In Sample 556AA cobalt was partially substituted for iron. The materials of Sample 556AA exhibited interactive properties, i.e., isotropic energy product above $(M_{sat}/4)^2$, and isotropic remanences above $(M_{sat}/2)$, as shown in Table II-3 below.

The as quenched and pelletized magnetic parameters obtained using the procedures described above are shown in Table II-3.

These measurements indicate that in alloys prepared by the low pressure melt spinning method of the invention described herein, (1) the lanthanum containing materials exhibited properties above those predicted by Stoner and Wohlfarth, and (2) the requisite grain size, grain size distribution, and intergranular boundary conditions for interactive enhanced parameters can be obtained under each of the following circumstances: (a) with partial substitution of lanthanum for neodymium and/or praseodymium; (b) without the presence of a modifier, (c) in alloys which were hyperstoichiometric in iron content, and (d) in alloys which contained cobalt.

While the invention has been described with respect to certain preferred exemplifications and embodiments, it is not intended to limit the scope of the invention thereby, but solely by the claims appended hereto.

What is claimed is:

1. A method of forming a particulate solid alloy, by the rapid solidification of a molten precursor of the alloy onto a rapidly moving chill surface, which method comprises:

(1) providing the molten precursor in a vessel in proximity to the chill surface;

(2) providing a subatmospheric pressure, non-reactive environment surrounding the chill surface and in proximity to the vessel;

(3) ejecting a stream of the molten precursor from the vessel, through the subatmospheric pressure, non-reactive environment, onto the rapidly moving chill surface; and (4) impinging the molten stream on the chill surface in the presence of the subatmospheric pressure, non-reactive environment, and causing a discontinuous stream of solid particles of the alloy to be thrown off of the rapidly moving chill surface, through the subatmospheric pressure, non-reactive environment, thereby producing a particulate solid, fine grain alloy, the particles thereof having a substantially narrow crystallographic size distribution therethrough.

2. The method of claim 1 wherein said alloy is a ferromagnetic alloy.

3. The method of claim 1 comprising solidifying said alloy into a particulate solid having a substantially single phase and comprised of crystallographic grains having a mean crystallite size, with a major portion of said individual grains having a crystallite size within a narrow distribution about the mean crystallite size, said distribution of individual crystallite sizes, and said grain boundaries being such as to provide a hard magnetic alloy having enhanced magnetic parameters.

4. The method of claim 1 wherein the non-reactive gas is chosen from the group consisting of helium, argon, hydrogen, nitrogen, and mixtures thereof.

5. The method of claim 1 wherein the subatmospheric pressure is below about 600 millimeters of mercury, absolute.

6. The method of claim 1 comprising maintaining the molten precursor quiescent in the vessel.

7. The method of claim 2 wherein the ferromagnetic alloy has a tetragonal crystal structure of the $P4_2/mnm$ type.

8. The method of claim 3 wherein the ferromagnetic alloy is $RE_2TM_{14}B_1$.

9. The method of claim 4 wherein the non-reactive gas is argon.

10. The method of claim 6 comprising indirectly heating the molten precursor.

11. The method of claim 8 wherein the ferromagnetic alloy has the nominal composition represented by $(RE)_2(TM)_4B_1(Si,Al)_d$ where TM represents a transition metal chosen from the group consisting of at least one of Fe, Co, Ni, and combinations thereof, RE represents a rare earth metal chosen from the group consisting of at least one of Nd, Pr, combinations thereof and combination thereof with other rare earths, B is boron, Si is silicon, Al is aluminum, d is an effective amount to provide the fine grain alloy having a narrow crystallite size distribution therethrough.

12. The method of claim 10 comprising indirect inductively heating the molten precursor through a susceptor.

13. The method of claim 12 comprising heating the molten precursor with an electrical field that is electrically decoupled from and thermally coupled to the molten precursor through the susceptor, whereby to maintain the precursor molten and quiescent.

14. A method of forming a particulate solid alloy, by the rapid solidification of a molten precursor of the alloy onto a rapidly moving chill surface, which method comprises:

(1) providing the molten precursor in a vessel in proximity to the chill surface;

(2) providing a subatmospheric pressure, non-reactive environment surrounding the chill surface and in proximity to the vessel;

(3) ejecting a stream of the molten precursor form the vessel, through the subatmospheric pressure, non-reactive environment, onto the rapidly moving chill surface;

(4) impinging the molten stream onto the chill surface in the presence of the subatmospheric pressure, non-reactive environment, and causing a discontinuous steam of solid particles of the alloy to be thrown off of the rapidly moving chill surface, through the subatmospheric pressure, non-reactive environment, thereby producing a particulate solid, fine grain alloy, the particles thereof having a substantially narrow crystallite size distribution therethrough; and (5) separating the alloy particles into fractions based upon the magnetic properties thereof.

15. The method of claim 14 comprising subjecting the particles to a magnetic field low enough to magnetize low magnetic parameter particles while substantially avoiding magnetization of high magnetic parameter particles, to magnetically attract said low magnet parameter particles.

16. A method of forming a particulate solid alloy, by the rapid solidification of a molten precursor of the alloy comprising a transition metal and a leachable metal onto a rapidly moving chill surface, which method comprises:

(1) providing the molten precursor in a vessel in proximity to the chill surface;

(2) providing a subatmospheric pressure, non-reactive environment surrounding the chill surface and in proximity to the vessel;

(3) ejecting a stream of the molten precursor from the vessel, through the subatmospheric pressure, non-reactive environment, onto the rapidly moving chill surface;

(4) impinging the molten stream onto the chill surface in the presence of the subatmospheric pressure, non-reactive environment, and causing a discontinuous stream of solid particles of the alloy to be thrown off of the rapidly moving chill surface, through the subatmospheric pressure, non-reactive environment, thereby producing a particulate solid, fine grain alloy, the particles thereof having substantially narrow crystallite size distribution therethrough and;

(5) leaching the leachable metal to form a porous solid.

17. The method of claim 16 wherein the leachable metal is chosen from the group consisting of zirconium, aluminum, and combinations thereof.

18. The method of claim 16 wherein the transition metal comprises nickel.

19. The method of claim 16 comprising leaching the leachable metal in an aqueous alkaline medium.

20. A method of forming concentrated, high magnetic parameter, ferromagnetic alloy which method comprises:

(1) providing a molten precursor of the alloy in a vessel in proximity to a chill surface;

(2) providing a controlled pressure, non-reactive environment surrounding the chill surface and in proximity to the vessel;

(3) ejecting a stream of the molten precursor from the vessel, through the controlled pressure, non-reactive environment, onto the chill surface;

(4) impinging the stream of molten precursor onto the chill surface in the presence of the controlled pressure, non-reactive environment, and causing a discontinuous stream of solid particles of the alloy to be thrown of the chill surface, through the controlled pressure, non-reactive environment, thereby producing a particulate solid fine grain alloy;

(5) subjecting the particles to a magnetic field low enough to magnetize low magnetic parameter, high initial magnetic susceptibility particles while substantially avoiding magnetization of high magnetic parameter, low initial magnetic susceptibility particles; and (6) magnetically attracting the low magnetic parameter, high initial magnetic susceptibility particles so as to magnetically separate the low magnetic parameter, high initial magnetic susceptibility particles from the high magnetic parameter, low initial magnetic susceptibility particles, and thereby recover concentrated, high magnetic parameter particles.

21. The method of claim 20 wherein said ferromagnetic alloy has a tetragonal crystal structure of the $P4_2/mnm$ type.

22. The method of claim 20 wherein the non-reactive gas is chosen from the group consisting of helium, argon, hydrogen, nitrogen, and mixtures thereof.

23. The method of claim 20 wherein the subatmospheric pressure is below about 600 millimeters of mercury, absolute.

24. The method of claim 20 comprising maintaining the molten precursor quiescent in the vessel.

25. The method of claim 21 wherein the ferromagnetic alloy is $RE_2TM_{14}B_1$.

26. The method of claim 22 wherein the non-reactive gas is argon.

27. The method of claim 24 comprising indirectly heating the molten precursor.

28. The method of claim 25 wherein the ferromagnetic alloy has the nominal composition represented by $$(RE)_2(TM)_4B_1(Si,Al)_d$$

where TM represents a transition metal chosen from the group consisting of at least one of Fe, Co, Ni, and combinations thereof, RE represents a rare earth metal chosen from the group consisting of at least one of Nd, Pr, combinations thereof and combination thereof with other rare earths, B is boron, Si is silicon, Al is aluminum, d is an effective amount to provide the fine grain alloy having a narrow crystallographic size distribution therethrough.

29. The method of claim 27 comprising indirectly inductively heating the molten precursor.

30. The method of claim 29 comprising heating the molten precursor with an electrical field that is electrically decoupled from and thermally coupled to the molten precursor, whereby to maintain the precursor molten and quiescent.

31. A method of forming a particulate solid alloy, by the rapid solidification of a molten precursor of the alloy onto a rapidly moving chill surface, which method comprises:

(1) providing the molten precursor in a vessel said vessel being surrounded by and in thermal contact with a susceptor, and being in proximity to the chill surface;

(2) directly inductively heating the susceptor to indirectly heat the molten precursor while maintaining the molten precursor quiescent;

(3) providing a subatmospheric pressure, non-reactive environment surrounding the chill surface and the proximity to the vessel;

(4) ejecting a stream of the molten precursor from the vessel, through the subatmospheric pressure, non-reactive environment, onto the rapidly moving chill surface; and (5) impinging the molten stream onto the chill surface in the presence of the subatmospheric pressure, non-reactive environment, and causing a discontinuous stream of solid particles of the alloy to be thrown off of the rapidly moving chill surface, through the subatmospheric pressure, non-reactive environment, thereby producing a particulate solid, fin grain alloy, the particles thereof having a substantially narrow crystallite size distribution therethrough.

* * * * *